US006565417B2

(12) United States Patent
Kase et al.

(10) Patent No.: US 6,565,417 B2
(45) Date of Patent: May 20, 2003

(54) METHOD FOR MANUFACTURING GLASS BASE MATERIAL AND GLASS BASE MATERIAL GRINDING APPARATUS

(75) Inventors: Hirofumi Kase, Gunma-ken (JP); Hiroyuki Koide, Ibaraki-ken (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 22 days.

(21) Appl. No.: 09/983,796

(22) Filed: Oct. 25, 2001

(65) Prior Publication Data

US 2002/0050154 A1 May 2, 2002

(30) Foreign Application Priority Data

Oct. 26, 2000 (JP) ..... 2000-327262

(51) Int. Cl.[7] ..... B24B 1/00

(52) U.S. Cl. ..... 451/6; 451/5; 451/41; 451/21; 451/49; 451/57; 451/63; 451/66

(58) Field of Search ..... 451/5, 6, 57, 49, 451/41, 21, 63, 66; 385/147; 356/445; 29/407.07

(56) References Cited

U.S. PATENT DOCUMENTS 4,053,237 A * 10/1977 Casey ..... 356/445
5,111,571 A * 5/1992 Ciboldi et al. ..... 29/407.07
5,741,172 A * 4/1998 Trionfetti et al. ..... 451/21
5,909,530 A * 6/1999 Ohkubo et al. ..... 385/147
6,257,964 B1 * 7/2001 Helgren ..... 451/49
6,273,783 B1 * 8/2001 Kim ..... 451/8
6,411,861 B1 * 6/2002 Clewes et al. ..... 700/164

FOREIGN PATENT DOCUMENTS

EP 0 976 689 A1 2/2000
JP 9-328328 12/1997
JP 2000-47039 2/2000

OTHER PUBLICATIONS

European Search Report dated Feb. 26, 2002.

* cited by examiner

*Primary Examiner*—George Nguyen
(74) *Attorney, Agent, or Firm*—McGinn & Gibb, PLLC

(57) ABSTRACT

An apparatus for grinding a glass base material having a core and a clad comprising: a grinding wheel for grinding the clad; a measuring unit for measuring an eccentricity between a center position of the glass base material and a center position of the core at a plurality of positions along a longitudinal direction of the glass base material; a design unit for calculating target diameters substantially continuous throughout the longitudinal direction of the glass base material so that the eccentricity becomes substantially zero for each of the plurality of positions; and a control unit for controlling the grinding wheel to grind the clad so that a diameter of the glass base material to be the target diameter substantially continuous throughout the longitudinal direction of the glass base material based on the target diameters calculated by the design unit.

18 Claims, 9 Drawing Sheets

| MEASUREMENT POSITION (mm) | $r_1$ (mm) | $r_2$ (mm) | $d_1$ (mm) | $d_2$ (mm) | T |
|---|---|---|---|---|---|
| A | 97 | 98 | 203 | 204 | 195 |
| B | 94 | 95 | 205 | 210 | 197 |
| ≈ | ≈ | ≈ | ≈ | ≈ | ≈ |
| G | 98 | 97 | 200 | 203 | 192 |

| MEASURING ITEMS | CONNECTION LOSS (dB) | ECCENTRICITY OF CORE (%) | FLUCTUATION RANGE OF λc (μm) |
|---|---|---|---|
| EXAMPLE | 0.02 | 0.15 | ±0.01 |
| COMPARATIVE EXAMPLE | 0.05 | 0.30 | ±0.04 |

FIG. 10

METHOD FOR MANUFACTURING GLASS BASE MATERIAL AND GLASS BASE MATERIAL GRINDING APPARATUS

This patent application claims priority from a Japanese patent application No. 2000-327262 filed on Oct. 26, 2000, the contents of which are incorporated herein by reference.

BACKGROUND OF THE INVENTION

1. Field of the Invention

The present invention relates to a glass base material grinding apparatus and a method for manufacturing a glass base material. More particularly, the present invention relates to a grinding apparatus and a method for manufacturing a glass base material having an excellent degree of circularity and also having an excellent eccentricity of a core.

2. Description of the Related Art

A porous glass base material, which is a base material of an optical fiber, is usually manufactured by accumulating glass particles on a surface of a core member by using a method such as the VAD (Vapor-phase Axial Deposition) method, or the OVD (Outside Vapor Deposition) method. A glass base material is manufactured by dehydrating and sintering the porous glass base material. The core member becomes a core of a glass base material after the glass base material is dehydrated and sintered. A preform is formed by elongating a glass base material, and an optical fiber is manufactured by drawing a preform.

As a method for increasing an accumulation speed of the glass particles on the surface of the core member in the OVD method, there are a method of using a burner having a large bore diameter and a method of increasing the number of burners. The burner ejects glass particles and accumulates glass particles on a surface of a core member. Furthermore, as a method for increasing the productivity of porous glass base material in the OVD method, there is a method of increasing the length of the core member to increase the ratio of the straight body part in the glass base material product. The straight body part has a uniform diameter.

The method of increasing the accumulation speed of the glass particles by increasing the bore diameter of the burner has a problem that the accumulation speed does not increase because the attachment ratio of the glass particles to the core member is extremely low at the initial process of the accumulation. Furthermore, if a plurality of burners are used, accumulation efficiency does not increase because each flame of the burners interferes with each other.

On the other hand, the method for increasing the number of burners has a problem of causing unevenness of the surface of the accumulated body of glass particles. In particular, if increasing the amount of raw material gas supplied to the burner increases the accumulation speed, the unevenness of the surface of the accumulated body becomes very significant. As a result, the optical fiber drawn from the glass base material manufactured by the OVD apparatus using an increased number of burners does not have a good optical characteristic. For example, a single mode optical fiber cannot have a desired cutoff wavelength and a dispersion characteristic.

Furthermore, in a case of the method that increases the length of the core member, the core member may bend during accumulation of the glass particles because the length of the core member is long. Thus, the resulting product cannot be used as a glass base material.

As a method for decreasing the unevenness that occurs on the surface of the glass base material and matching the center position of the core with the center position of the glass base material, there is a method of grinding the glass base material. The method of grinding the glass base material to match the center position of the core member and the center position of the glass base material is disclosed in Japanese Patent Application Laying-Open No. H9-328328 and Japanese Patent Application Laying-Open No. 2000-47039.

However, the method disclosed in Japanese Patent Application Laying-Open No. H9-328328 and Japanese Patent Application Laying-Open No. 2000-47039 could not match the center position of the core member and the center position of the glass base material when the core member is bent throughout the longitudinal direction of the glass base material.

Furthermore, the methods disclosed in Japanese Patent Application Laying-Open No. H9-328328 and Japanese Patent Application Laying-Open No. 2000-47039 have a problem that a cutoff wavelength of the optical fiber, which is drawn from the glass base material, becomes uneven through the longitudinal direction of the glass base material according to the fluctuation of the diameter of a core member through the longitudinal direction of the glass base material. This problem occurs because the methods disclosed in Japanese Patent Application Laying-Open No. H9-328328 and Japanese Patent Application Laying-Open No. 2000-47039 grind the glass base material such that the diameter of the glass base material becomes constant throughout the longitudinal direction of the glass base material.

Furthermore, when the center position of the core member is different from the center position of the glass base material, the optical fiber obtained by drawing this glass base material causes a connection loss when each end of the two optical fibers are fused and connected to construct an optical fiber network.

SUMMARY OF THE INVENTION

Therefore, it is an object of the present invention to provide a method for manufacturing a glass base material and a glass base material grinding apparatus, which is capable of overcoming the above drawbacks accompanying the conventional art. The above and other objects can be achieved by combinations described in the independent claims. The dependent claims define further advantageous and exemplary combinations of the present invention.

According to the first aspect of the present invention, an apparatus for grinding a glass base material having a core and a clad comprises: a grinding wheel for grinding the clad; a measuring unit for measuring eccentricity between a center position of the glass base material and a center position of the core in a direction perpendicular to a longitudinal direction of the glass base material at a plurality of positions along a longitudinal direction of the glass base material; a design unit for calculating target diameters of the glass base material substantially continuous throughout the longitudinal direction of the glass base material by calculating the target diameters, a center position of said target diameter is the same as the center position of the core for each of said plurality of positions along a longitudinal direction of the glass base material, so that the eccentricity becomes substantially zero for each of the plurality of positions where the eccentricity is measured by the measuring unit; and a control unit for controlling the grinding wheel to grind the clad so that a diameter of the glass base material to be the target diameter, the center position of which is at the center position of the core, substantially continuous throughout the longitudinal direction of the glass base material based on the target diameters calculated by the design unit.

The design unit may calculate the target diameter substantially continuous throughout the longitudinal direction of the glass base material by calculating the target diameter at a position between the plurality of positions where the eccentricity is measured by the measuring unit based on the eccentricity measured at the plurality of positions by the measuring unit. The design unit may calculate the target diameter at a position between the plurality of positions using the least-squares method.

The control unit may grind the clad by moving the grinding wheel back and forth in the direction toward the center of the glass base material. The control unit may rotate the glass base material around the axis of the glass base material and may move the grinding wheel back and forth toward the center of the glass base material so that movement of the grinding wheel against the glass base material forms a sine curve with an increase in an amount of rotation of the glass base material.

A number of the plurality of positions for measuring the eccentricity along a longitudinal direction of the glass base material may be substantially more than twenty.

The design unit may calculate the target diameters at each of the plurality of positions and the positions between the plurality of positions so that a ratio between a diameter of the core and a diameter of the glass base material becomes substantially constant throughout a longitudinal direction of the glass base material.

The grinding wheel may include: a coarse grinding wheel having a coarse surface; a fine grinding wheel having a fine surface; and the control unit grinds the clad using the fine grinding wheel after grinding the clad using the coarse grinding wheel.

The apparatus may further comprise a plurality of the grinding wheels, wherein the grinding wheels are arranged parallel along a longitudinal direction of the glass base material.

According to the second aspect of the present invention, a method for manufacturing a glass base material having a core and a clad comprises: accumulating glass particles around a core member, which becomes the core, to form a porous glass base material; dehydrating and sintering the porous glass base material to form a glass base material; measuring an eccentricity between a center position of the glass base material and a center position of the core in a direction perpendicular to a longitudinal direction of the glass base material at a plurality of positions along a longitudinal direction of the glass base material; calculating target diameters of the glass base material substantially continuous throughout the longitudinal direction of the glass base material by calculating the target diameters, a center position of said target diameter is the same as the center position of the core for each of said plurality of positions along a longitudinal direction of the glass base material, so that the eccentricity becomes substantially zero for each of the plurality of positions where the eccentricity is measured by the measuring; and grinding the clad with a grinding wheel so that a diameter of the glass base material to be the target diameter, the center position of which is at the center position of the core, substantially continuous throughout the longitudinal direction of the glass base material based on the target diameters calculated substantially continuous throughout the longitudinal direction of the glass base material.

Calculating may calculate the target diameter substantially continuous throughout the longitudinal direction of the glass base material by calculating the target diameter at positions between the plurality of positions where the eccentricity is measured by the measuring based on the eccentricity measured at the plurality of positions. The calculating step may calculate the target diameter at positions between the plurality of positions using the least-squares method.

The grinding may grind the clad by moving the grinding wheel back and forth in the direction toward the center of the glass base material. The grinding may rotate the glass base material around the axis of the glass base material and may move the grinding wheel back and forth toward the center of the glass base material so that movement of the grinding wheel against the glass base material forms a sine curve with an increase of an amount of rotation of the glass base material.

The measuring may measure the eccentricity along a longitudinal direction of the glass base material for more than twenty places along a longitudinal direction of the glass base material. The calculating may calculate the target diameters at each of the plurality of positions and the positions between the plurality of positions so that a ratio between a diameter of the core and a diameter of the glass base material becomes substantially constant throughout a longitudinal direction of the glass base material.

The grinding may grind the clad by a fine grinding wheel, which has a fine surface, after grinding the clad by a coarse grinding wheel, which has a coarse surface. The grinding may grind the clad using a plurality of the grinding wheels arranged parallel along a longitudinal direction of the glass base material.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

BRIEF DESCRIPTION OF THE DRAWINGS

FIG. 10 shows a result of measuring the above-mentioned items.

DETAILED DESCRIPTION OF THE INVENTION

The invention will now be described based on the preferred embodiments, which do not intend to limit the scope of the present invention, but exemplify the invention. All of the features and the combinations thereof described in the embodiments are not necessarily essential to the invention.

Figure 1:
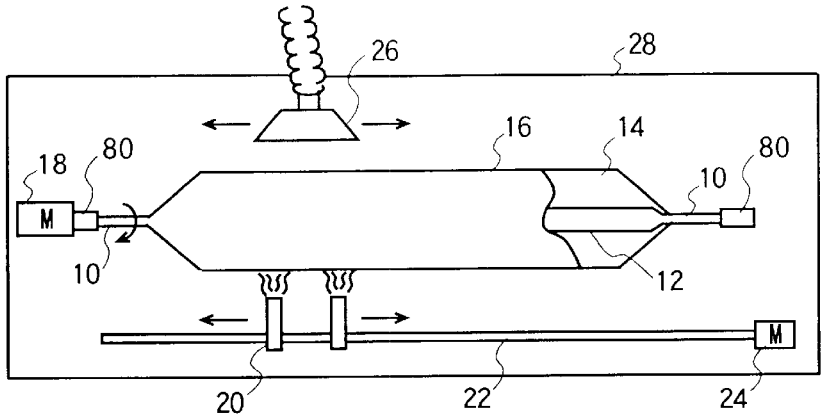
FIG. 1 shows a configuration of an apparatus for manufacturing a porous glass base material of an embodiment of the present invention.

FIG. 1 shows a configuration of an apparatus for manufacturing a porous glass base material of an embodiment of the present invention. The apparatus for manufacturing a porous glass base material shown in FIG. 1 manufactures the porous glass base material using the OVD method.

A porous glass base material manufacturing apparatus comprises chucks 80, a motor 18, a plurality of burners 20, a burner guide structure 22, a burner moving motor 24, a reaction furnace 28, and an exhaust hood 26.

Each end of the core member 12 is connected to the corresponding dummy rods 10, and each of the chucks 80 hold the corresponding dummy rods 10. The motor 18 rotates the chucks 80. The burners 20 accumulate the glass particles on the core member 12. The burner guide structure 22 and the burner moving motor 24 move the burners 20 in the longitudinal direction of the core member 12. The reaction furnace 28 accommodates the elements of the porous glass base material manufacturing apparatus such as the core member 12 and the burners 20. The exhaust hood 26 exhausts the exhaustion gas, which is generated inside the reaction furnace 28.

The motor 18 rotates the core member 12 by rotating the chucks 80. The burners 20 form a clad member 14 around the surface of the core member 12 to form a porous glass base material by ejecting and accumulating the glass particles on the core member 12, which is rotated by the motor 18. The burners 20 generate glass particles by ejecting a raw material gas, such as $SiCl_4$, and combustion gas and hydrolyzing the raw material gas and combustion gas in the oxyhydrogen flame.

Considering the attachment of the glass particles on the core member 12, the speed of supplying the raw material gas and the combustion gas to the burners 20 is preferably increased gradually after starting the accumulation of the glass particles.

The burner guide structure 22 is arranged parallel to the longitudinal direction of the core member 12. The burner moving motor 24 moves the burners 20 along the longitudinal direction of the burner guide structure 22 by driving the burner guide structure 22. Therefore, the glass particles are accumulated around the core member 12 and accumulated along the longitudinal direction of the core member 12. The glass particles are accumulated around the core member 12 until the porous glass base material 16 has a predetermined size. Then, the porous glass base material 16 is dehydrated and sintered to be a glass base material.

Figure 2:
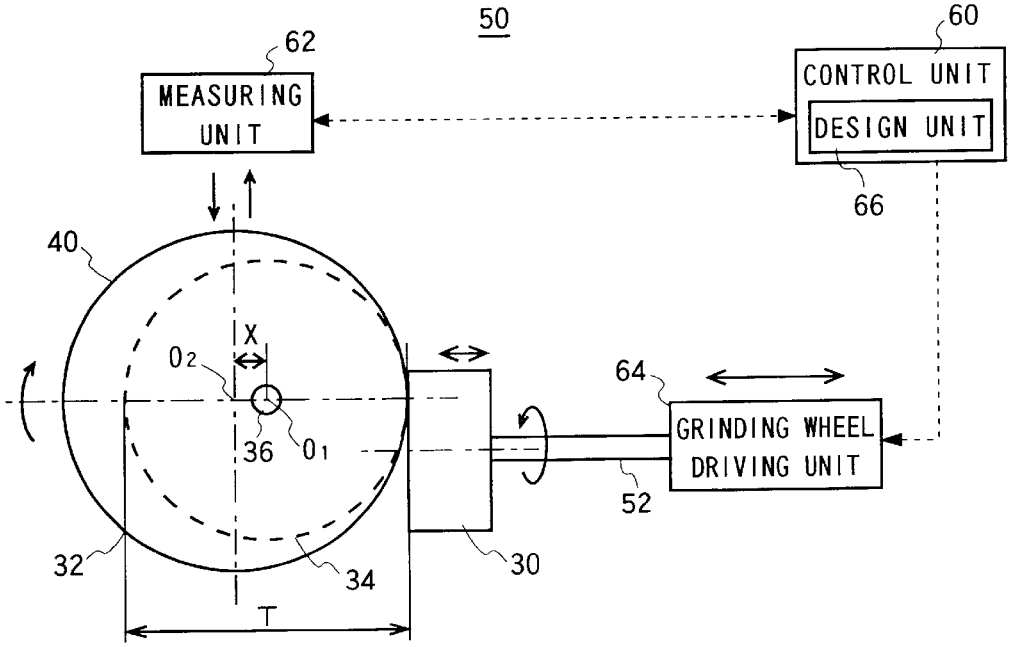
FIG. 2 shows a configuration of a glass base material grinding apparatus 50 of an embodiment of the present invention.

FIG. 2 shows a configuration of a glass base material grinding apparatus 50 of an embodiment of the present invention. FIG. 2 shows the glass base material grinding apparatus 50 from the direction where the cross section of a glass base material 40, which is cut along the direction perpendicular to the longitudinal direction of the glass base material 40, can be seen.

The glass base material 40 has a core 36 and a clad 32. In FIG. 2, the position of the center $O_1$ of the core 36 does not match the position of the center $O_2$ of the glass base material 40. The glass base material grinding apparatus 50 grinds the clad 32 of the glass base material 40 using the grinding wheel 30 until the diameter of the glass base material 40 becomes the diameter of the target clad 34 shown by the hidden line in FIG. 2. The position of the center of the target clad 34 is identical to the position of the center $O_1$ of the core 36. Thereby, the position of the center $O_1$ of the core 36 matches the position of the center $O_2$ of the glass base material.

A cylindrical grinder as shown in FIG. 2 is preferably used as a glass base material grinding apparatus 50 of the present embodiment. The cylindrical grinder rotates an object to be grinded and grinds the outside surface of the object. The glass base material grinding apparatus 50 comprises a grinding wheel 30, a grinding wheel driving unit 64, a control unit 60, and a measuring unit 62.

While the glass base material 40 is rotated around the center $O_2$ as an axis, the grinding wheel 30 grinds the clad 32. The grinding wheel 30 is connected to the grinding wheel driving unit 64 via the axis 52. The grinding wheel driving unit 64 rotates the grinding wheel 30 around the axis 52 and also moves the grinding wheel 30 back and forth towards the center $O_2$ of the glass base material 40. Thus, the grinding wheel 30 grinds the clad 32 while the grinding wheel 30 is rotated around the axis 52 and also pressed against the clad 32.

The measuring unit 62 measures an amount of eccentricity X between the position of the center $O_2$ of the glass base material 40 and the position of the center $O_1$ of the core 36 at a plurality of positions along the longitudinal direction of the glass base material 40. As an example of a measuring instrument, a measuring instrument using a polarizing glass or a preform analyzer may be used. The preform analyzer irradiates laser light on the glass base material 40 and obtains a refractive index distribution inside the glass base material 40 by measuring a gap of the position of the light caused while the light transmits through the glass base material 40. The position of the center $O_1$ of the core 36 inside the glass base material 40 can be found from the obtained refractive index distribution.

In a case of using the measuring instrument that uses a polarizing glass as the measuring unit 62, the measuring unit 62 is provided to the glass base material grinding apparatus 50 as a part of the glass base material grinding apparatus 50.

Because the measuring unit 62 is connected to the control unit 60, the measuring unit 62 can directly output the measurement result to the control unit 60. Because the measuring unit 62 and the control unit 60 are directly connected, the time and work taken for inputting the measurement result to the control unit 60 can be greatly reduced when compared to the time and work taken for inputting the measurement results to the control unit 60 by hand. Furthermore, mistakes, which may occur while inputting the measurement results to the control unit 60, can be prevented.

In a case of using the preform analyzer as the measuring unit 62, the measuring unit 62 is provided separately with the glass base material grinding apparatus 50. Furthermore, the measuring unit 62 is connected to the control unit 60 so that the measuring unit 62 can directly output the measurement result to the control unit 60. Because the measuring unit 62 and the control unit 60 are directly connected, the time and work taken for inputting the measurement result to the control unit 60 can be greatly reduced when compared to the time and work taken to input the measurement results to the control unit 60 by hand. Furthermore, mistakes, which may occur while inputting the measurement results to the control unit 60, can be prevented.

When the preform analyzer is used for measuring the position of the center $O_1$ of the core 36, the glass base material 40 is installed inside the preform analyzer. The measuring unit 62 measures the position of the center $O_1$ of the core 36 inside the glass base material 40 using the preform analyzer. Then, the measuring unit 62 directly outputs the measuring result to the control unit 60 of the glass base material grinding apparatus 50.

The apparatus used for measuring the position of the center $O_1$ of the core 36 inside the glass base material 40 is not limited to a preform analyzer or a measuring instrument using polarizing glass, but other types of optical measuring instruments may be used.

The control unit 60 has a design unit 66. The design unit 66 calculates target diameters T of the glass base material 40 at each of a plurality of places where the eccentricity X is measured by the measuring unit 62. The position of the center of the target diameter T is the same as the position of the center $O_1$ of the core 36. The design unit 66 calculates target diameters T such that the position of the center $O_1$ of the core 36 and the position of the center $O_2$ of the glass base material 40 matches. Thus, the amount of eccentricity X becomes substantially zero at each of the plurality of places where the eccentricity X is measured.

Furthermore, the design unit 66 calculates the target diameter T substantially continuous throughout the longitudinal direction of the glass base material 40 by calculating the target diameter T at a place between the plurality of positions where the amount of eccentricity X is measured. The place between the positions where the amount of eccentricity X is measured is the place where the amount of eccentricity X is not measured by the measuring unit 62. For example, the design unit 66 may calculate the target diameter T at the place between the plurality of positions where the amount of eccentricity X is measured using a least-squares method. Furthermore, the method for calculating the amount of eccentricity X at the position between the plurality of positions is not limited to the least-squares method, but other methods may also be used.

Furthermore, the design unit 66 calculates the target diameter T such that the estimated cutoff wavelength of the optical fiber obtained from the glass base material 40 becomes substantially constant throughout the longitudinal direction of the optical fiber. The estimated cutoff wavelength of the optical fiber obtained from the glass base material 40 becomes substantially constant throughout the longitudinal direction of the optical fiber when the ratio between the diameter of the core 36 and the diameter of the clad 32 is constant throughout the longitudinal direction of the glass base material 40.

If the outside diameter of the glass base material 40 is constant throughout the longitudinal direction of the glass base material 40, and the diameter of the core 36 is not uniform throughout the longitudinal direction of the glass base material 40, the ratio between the diameter of the core 36 and the diameter of the clad 32 is not constant throughout the longitudinal direction of the glass base material 40. Therefore, the cutoff wavelength of the optical fiber manufactured from this glass base material 40 does not become constant throughout the longitudinal direction of the optical fiber, and this optical fiber thus cannot be used as a product.

Thus, the estimated cutoff wavelength of the optical fiber obtained from the glass base material 40 has to be constant throughout the longitudinal direction of the glass base material 40. Therefore, the design unit 66 calculates the target diameter T at each of the plurality of places, where the amount of eccentricity X is measured, and each of the places between each of the plurality of places, where the amount of eccentricity X is measured, so that the ratio between the diameter of the core 36 and the diameter of the clad 32 becomes constant throughout the longitudinal direction of the glass base material 40.

Therefore, if the diameter of the core 36 varies along the longitudinal direction of the glass base material 40, the design unit 66 calculates the target diameter T such that the outside diameter of the glass base material 40 varies according to the change in the diameter of the core 36. Thus, the design unit 66 calculates the target diameter T such that the target diameter T varies along the longitudinal direction of the glass base material 40 if the diameter of the core 36 varies along the longitudinal direction of the glass base material 40.

The control unit 60 controls the grinding wheel driving unit 64 so that the grinding wheel 30 moves back and forth toward the center $O_2$ of the glass base material 40. The control unit 60 grinds the clad 32 by controlling the rotation speed of the grinding wheel 30 and the amount of movement of the grinding wheel 30 toward the center $O_2$ of the glass base material 40 with the grinding wheel driving unit 64.

Figure 3:
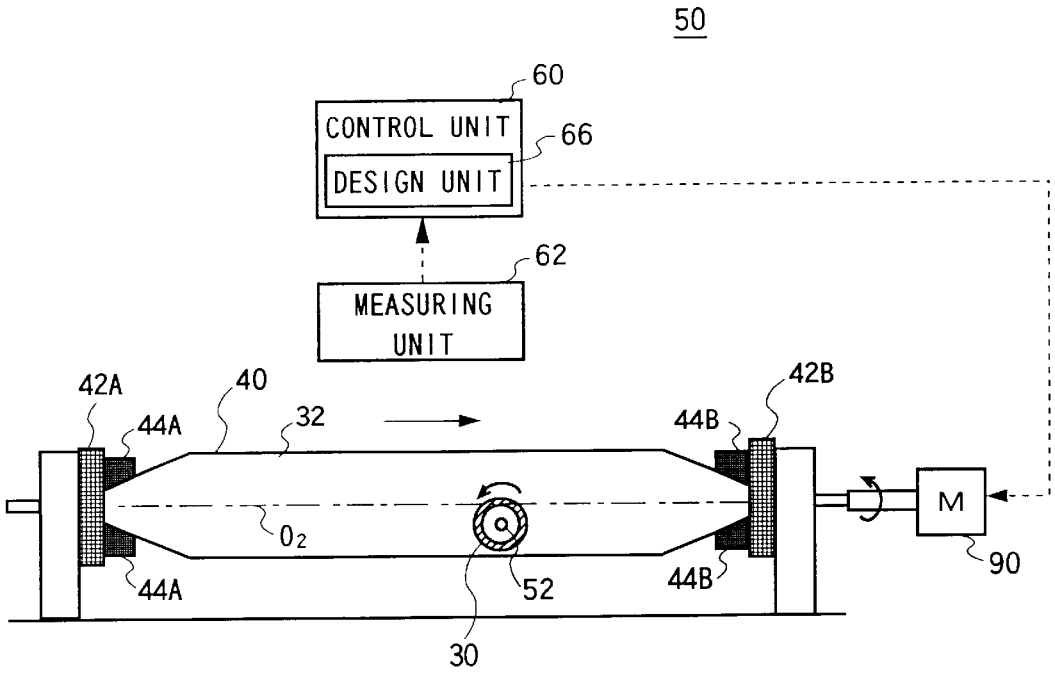
FIG. 3 shows the glass base material grinding apparatus 50 shown in FIG. 2 from the direction where the longitudinal direction of the glass base material 40 can be seen.

FIG. 3 shows the glass base material grinding apparatus 50 shown in FIG. 2 from the direction where the longitudinal direction of the glass base material 40 can be seen. The glass base material grinding apparatus 50 comprises the elements explained in FIG. 2. The glass base material grinding apparatus 50 further comprises chucks 44A and 44B, chuck supporting units 42A and 42B, and a motor 90.

The chucks 44A and 44B hold each end of the glass base material 40. The chuck supporting units 42A and 42B support the chucks 44A and 44B. The motor 90 rotates the chuck supporting units 42A and 42B around the center $O_2$ of the glass base material 40. Therefore, the glass base material 40 is rotated around the center $O_2$ by the motor 90.

While the glass base material 40 is rotated around the center $O_2$, the grinding wheel 30 grinds the clad 32. As explained in FIG. 2, the grinding wheel 30 rotates around the axis 52 and also moves back and forth toward the center $O_2$ of the glass base material 40. Furthermore, the glass base material grinding apparatus 50 moves the glass base material 40 to the direction shown in the arrow of FIG. 3 along the longitudinal direction of the glass base material 40.

Thus, the grinding wheel 30 can grind the clad 32 so that the center $O_1$ of the core 36 and the center $O_2$ of the glass base material 40 substantially matches throughout the longitudinal direction of the glass base material 40. Therefore, the grinding wheel 30 can grind the clad 32 so that the amount of eccentricity X between the position of the center $O_1$ of the core 36 and the position of the center $O_2$ of the glass base material 40 becomes substantially zero throughout the longitudinal direction of the glass base material 40.

Figure 4A:
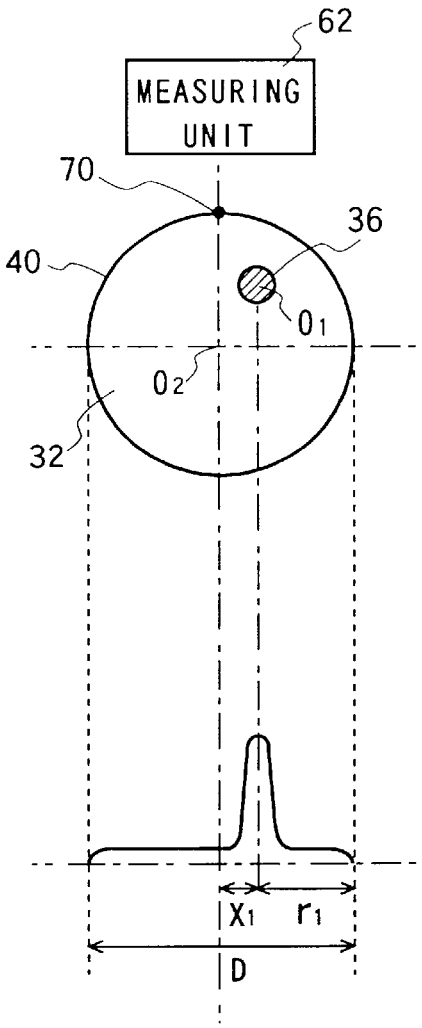
FIGS. 4A and 4B show a result of measuring the position of the center $O_1$ of the core 36 inside the glass base material 40 by the measuring unit 62.
Figure 4B:
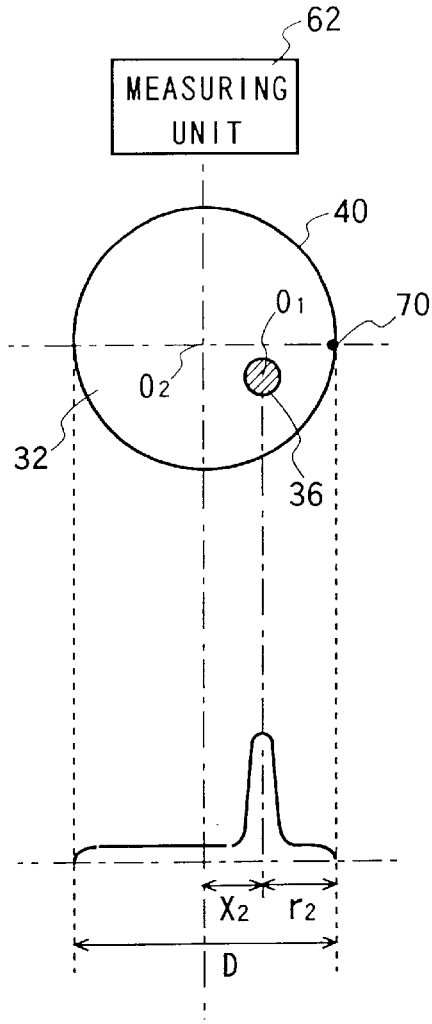

FIGS. 4A and 4B show a result of measuring the position of the center $O_1$ of the core 36 inside the glass base material 40 by the measuring unit 62. FIG. 4B shows a result of measuring the position of the center $O_1$ of the core 36 in the state where the glass base material 40 is rotated 90 degrees from the position of the glass base material 40 shown in FIG. 4A.

A preform analyzer is used for the measuring unit 62. A marking 70 is provided on the predetermined position on the surface of the clad 32. In FIG. 4A, the measuring unit 62 irradiates a laser light to the glass base material 40 from the position of the marking 70 and measures the gap of the position of the light that pass through the glass base material 40. Thereby, the measuring unit 62 can measure the refractive index distribution inside the glass base material 40 as shown in each lower part of FIGS. 4A and 4B. As shown in FIGS. 4A and 4B, the refractive index of the core 36 is higher than the refractive index of the clad 32. Thus, the position of the center $O_1$ of the core 36 inside the glass base material 40 can be measured.

Furthermore, because the diameter D of the clad 32 can be obtained from the refractive index distribution shown in FIGS. 4A and 4B, the position of the center $O_2$ of the glass base material 40 can be found. The amount of eccentricity $X_1$ between the position of the center $O_2$ of the glass base material 40 and the position of the center $O_1$ of the core 36 can be calculated based on the position of the center $O_2$ of the glass base material 40 and the position of the center $O_1$ of the core 36 measured by the measuring unit 62. Then, the distance $r_1$ from the surface of the clad 32 to the center $O_1$ of the core 36 is calculated based on the diameter D of the clad 32 and the amount of eccentricity $X_1$.

Then, as shown in FIG. 4B, the glass base material 40 is rotated clockwise 90 degrees around the center $O_2$ of the glass base material 40 from the state shown in FIG. 4A. Then, the position of the center $O_1$ of the core 36 inside the glass base material 40 is measured again. The amount of eccentricity $X_2$ between the position of the center $O_2$ of the glass base material 40 and the position of the center $O_1$ of the core 36 can be obtained by this measurement. Furthermore, the distance $r_2$ from the surface of the clad 32 to the center $O_1$ of the core 36 is calculated based on the diameter D of the clad 32 and the amount of eccentricity $X_2$.

Thus, the position of the center $O_1$ of the core 36 inside the glass base material 40 is determined based on the amounts of eccentricity $X_1$ and $X_2$ between the position of the center $O_2$ of the glass base material 40 and the position of the center $O_1$ of the core 36.

Figure 5:
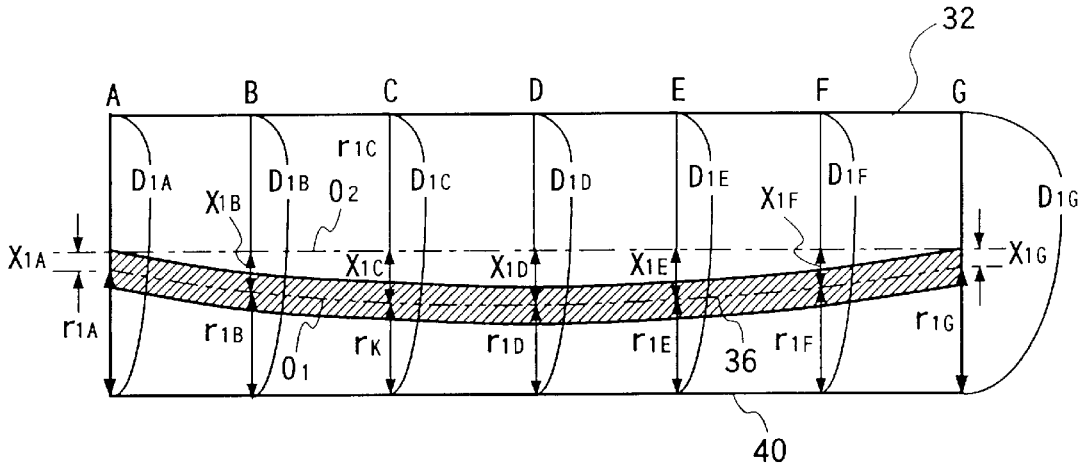
FIG. 5 shows a result of measuring the position of the center $O_1$ of the core 36 inside the glass base material 40 by the measuring unit 62.

FIG. 5 shows a state of measuring an amount of eccentricity X1, as explained in FIG. 4, at a plurality of positions along the longitudinal direction of the glass base material 40. In FIG. 5, the amounts of eccentricity $X_{1A}$-$X_{1G}$ and the diameters $D_{1A}$-$D_{1G}$ are measured at seven places from A to G, which are positioned at equal intervals along the longitudinal direction of the glass base material 40. Therefore, the distances $r_{1A}$-$r_{1G}$ from the surface of the clad 32 to the center $O_1$ of the core 36 for each measurement place from A to G can be calculated from the diameters $D_{1A}$-$D_{1G}$ and the amounts of eccentricity $X_{1A}$-$X_{1G}$.

Next, similar to FIG. 4B, the glass base material grinding apparatus 50 rotates the glass base material 40 90 degrees around the center $O_2$. The glass base material grinding apparatus 50 then measures the amounts of eccentricity $X_{2A}$-$X_{2G}$ and the diameters $D_{2A}$-$D_{2G}$ at seven places from A to G along the longitudinal direction of the glass base material 40. Thus, the distances $r_{2A}$-$r_{2G}$ from the surface of the clad 32 to the center $O_1$ of the core 36 for each of the measurement places from A to G are calculated based on the diameters $D_{2A}$-$D_{2G}$ and the amounts of eccentricity $X_{2A}$-$X_{2G}$.

In FIG. 5, the amounts of eccentricity $X_1$ and $X_2$ are measured for each of seven places A to G along the longitudinal direction of the glass base material 40 as an example. However, the places for measuring the amounts of eccentricity $X_1$ and $X_2$ are not limited to the seven places. If the total length of the glass base material 40 is of a normal length, such as from 1200 mm to 1500 mm, for example, the measurement places for the amounts of eccentricity $X_1$ and $X_2$ along the longitudinal direction of the glass base material 40 is preferably more than 20 places.

If the measurement places are fewer than 20 places, the accuracy of the alignment between the position of the center $O_2$ of the glass base material 40 and the position of the center $O_1$ of the core 36 becomes worse. Furthermore, the number of places for measuring the amounts of eccentricity $X_1$ and $X_2$ are preferably more than 30 places. The numbers of the measurement places are preferably determined according to the total length of the glass base material 40 and the accuracy required for the glass base material product.

For example, if the length of the glass base material 40 is 1500 mm, the amounts of eccentricity $X_1$ and $X_2$ are measured at 50 mm intervals along the longitudinal direction of the glass base material 40. In this case, the amounts of eccentricity $X_1$ and $X_2$ are measured at 31 places along the longitudinal direction of the glass base material 40. Because the amounts of eccentricity $X_1$ and $X_2$ are measured for two degrees of 0 degrees and 90 degrees as shown in FIGS. 4A and 4B, the amounts of eccentricity $X_1$ and $X_2$ are measured at a total of 62 places.

Figure 6:
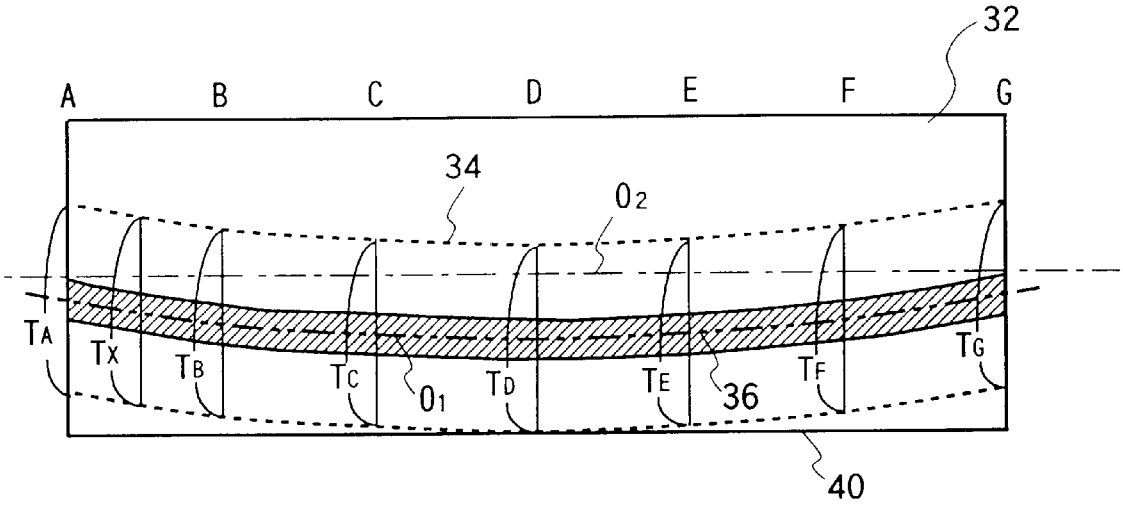
FIG. 6 shows target diameters $T_A$-$T_G$ for each plurality of positions A-G along a longitudinal direction of the glass base material 40.

FIG. 6 shows target diameters $T_A$-$T_G$ for each plurality of positions A-G along a longitudinal direction of the glass base material 40. The target diameters $T_A$-$T_G$ are designed based on the measuring results shown in FIG. 5.

The design unit 66 calculates the target diameters $T_A$-$T_G$, the position of the center of which is located at the position of the center $O_1$ of the core 36, based on the amounts of eccentricity $X_{1A}$-$X_1$ measured at a plurality of places A-G by the measuring unit 62. The design unit 66 calculates the target diameters $T_A$-$T_G$ so that each of the amounts of eccentricity $X_{1A}$-$X_{1G}$ becomes substantially zero when the outside diameter of the clad 32 is grinded to be a target diameter T.

In FIG. 6, the target diameters $T_A$-$T_G$ are shown by the hidden line. The target diameters $T_A$-$T_G$ are the diameters of the target clad 34 at each plurality of places A-G. If the diameter of the core 36 is different for each plurality of places A-G, each of the target diameters $T_A$-$T_G$ are also different.

Furthermore, the design unit 66 calculates target diameters $T_x$ at the positions between each plurality of places A-G. In FIG. 6, the design unit 66 calculates target diameters $T_x$, the position of the center of which is at the position of the center $O_1$ of the core 36, at the desired position between the measuring places A and B. The target diameters $T_x$, the position of the center of which is at the position of the center $O_1$ of the core 36, are also calculated at the desired positions between the measuring places B and D, C and D, D and E, E and F, and F and G.

Therefore, the design unit 66 calculates the target diameter T such that the amount of eccentricity X becomes substantially zero substantially continuous throughout the longitudinal direction of the glass base material 40 as shown by the hidden line in FIG. 6. The design unit 66 may calculate the target diameters $T_x$ at the position between the plurality of places by a least-square method. The method for calculating the target diameters $T_x$ between the plurality of places is not limited to the least-square method, and other methods may be used.

Furthermore, it is preferable that the design unit 66 calculates the target diameters $T_A$-$T_G$ and $T_x$ so that the estimated cutoff wavelength of the optical fiber obtained from the glass base material 40 becomes substantially constant throughout the longitudinal direction of the glass base material 40. Therefore, the design unit 66 calculates the target diameters $T_A$-$T_G$ and $T_x$ such that the ratio between the diameter of the core 36 and the diameter of the clad 32 becomes constant throughout the longitudinal direction of the glass base material 40.

Figures 7A, 7B:
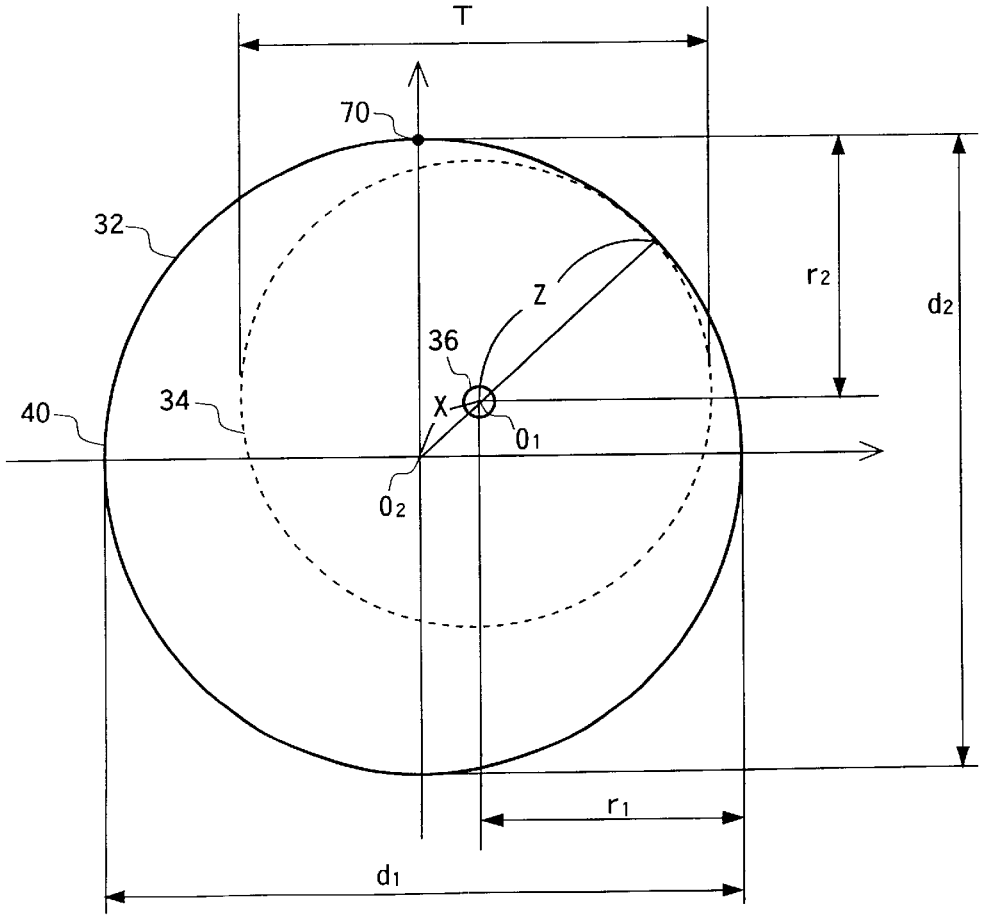
FIGS. 7A and 7B show an example of the result of the design of the design unit 66.

FIGS. 7A and 7B show an example of the result of the design of the design unit 66. FIG. 7A shows the distances $r_1$ and $r_2$, the diameters $d_1$-$d_2$ of the glass base material 40, and the target diameter T at each measuring place A-G. The values of the distances $r_1$ and $r_2$, the diameters $d_1$ and $d_2$ of the glass base material 40, and the target diameter T shown in FIG. 7A are shown merely as an example and are not limited to the values shown in FIG. 7A.

The control unit 60 inputs the values of the distances $r_1$ and $r_2$, the diameters $d_1$ and $d_2$, and the target diameter T from the measuring unit 62. Thus, the control unit 60 controls the grinding wheel 30 based on the distance $r_1$ and $r_2$, the diameters $d_1$ and $d_2$, and the target diameter T.

The clad 32 before the clad 32 is grinded is shown by a solid line, and the target clad 34 is shown by a hidden line in FIG. 7B. As shown in Fig. 7B, the value of target diameter T is determined by the distance Z. The distance Z is a distance from the position of the center $O_1$ of the core 36 to the position of the surface of the glass base material 40, which is nearest from the center $O_1$ of the core 36. The value of the half of the target diameter T is substantially the same as the distance Z or smaller.

The glass base material grinding apparatus 50 grinds the clad 32 so that the clad 32 shown by the solid line becomes the shape and size of the target clad 34 shown by the hidden line in FIG. 7B. To accomplish this purpose, the control unit 60 recognizes the position of the center $O_1$ of the core 36 based on the distances $r_1$ and $r_2$ and grinds the clad 32 by controlling the grinding wheel 30. The control unit 60 grinds the clad 32 such that the diameter of the glass base material 40 becomes the target diameter T, the position of the center of which is at the position of the center $O_1$ of the core 36.

Figure 8:
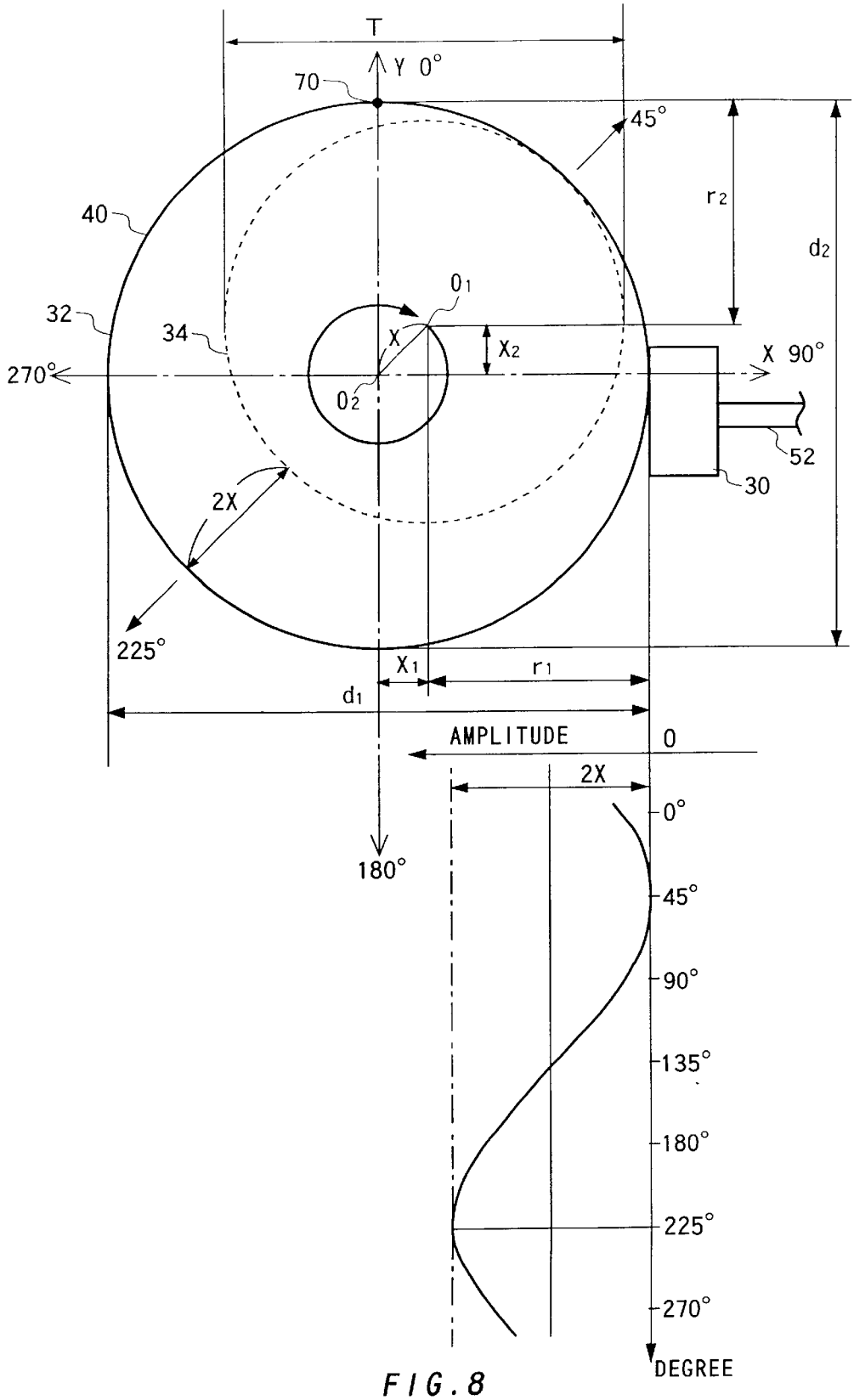
FIG. 8 shows the state where the grinder 30 grinds the clad 32 based on the design of the design unit 66.

FIG. 8 shows the state where the grinder 30 grinds the clad 32 based on the design of the design unit 66. The top part of FIG. 8 shows the relationship between the position of the glass base material 40 and the position of the grinder 30. The bottom part of FIG. 8 shows a trail of movement of the grinder 30.

The control unit 60 moves the grinding wheel 30 back and forth toward the position of the center $O_2$ of the glass base material 40 based on the target diameter T, the center of which is at the center $O_1$ of the core 36, calculated by the design unit 66. While the clad 32 is grinded, the glass base material 40 is rotated around the center $O_2$ of the glass base material 40. As shown in the bottom part of FIG. 8, the control unit 60 moves the grinding wheel 30 so that the trace of the movement of the grinding wheel 30 against the glass base material 40 draws a sine curve according to the increase of the amount of rotation of the glass base material 40.

To match the position of the center $O_1$ of the core 36 with the position of the center $O_2$ of the glass base material 40, the clad 32 has to be grinded until the shape and the size of the clad 32 shown by the solid line becomes the shape and the size of the target clad 34 shown by the hidden line. Because the position of the center $O_1$ of the core 36 and the position of the center $O_2$ of the glass base material 40 is different, the center $O_1$ of the core 36 draws a circle having a radius of X around the center $O_2$ of the glass base material 40 when the glass base material 40 is rotated around the center $O_2$ of the glass base material 40.

The amount of clad 32 to be grinded shown in FIG. 8 is approximately zero in the direction about 45 degrees clockwise from the Y-axis. The amount of clad 32 to be grinded becomes approximately equal to the maximum value of 2X in the direction about 225 degrees clockwise from the Y-axis. The amount of clad 32 to be grinded becomes approximately zero again in the direction about 45 degrees clockwise from the Y-axis when the glass base material 40 is rotated in a complete circle.

In this way, the amount of clad 32 to be grinded changes periodically according to the amount of rotation of the glass base material 40 around the center $O_2$. In FIG. 8, the rotation of the glass base material 40 for one complete circle corresponds to one period of the trace of the movement of the grinding wheel 30 shown in the bottom part of FIG. 8.

Therefore, the control unit 60 moves the grinding wheel 30 back and forth against the glass base material 40 such that the sine curve, which shows the trace of the movement of the grinding wheel 30, draws one period when the glass base material 40 is rotated in a complete circle around the center $O_2$. The control unit 60 also sets the amplitude 2X of the sine curve according to the amount of eccentricity X between the position of the center $O_1$ of the core 36 and the position of the center $O_2$ of the glass base material 40.

Furthermore, if it is difficult to complete the grinding process of the clad 32 during one rotation of the glass base material 40, the control unit 60 may move the grinding wheel 30 such that the grinding wheel 30 gradually approaches the center $O_2$ of the clad 32 for every one rotation of the glass base material 40. For example, the movement of the grinding wheel 30 may draw the sine curve such that the turning point of the sine curve gradually moves closer to the center $O_2$ of the glass base material 40 with the progress of the grinding process.

Furthermore, as shown in FIG. 6, the values of the target diameter $T_A$-$T_G$ may be different for each position A-G in the longitudinal direction of the glass base material 40. Therefore, the control unit 60 may change the amplitude 2X of the movement of the grinding wheel 30 based on the target diameter T when the glass base material 40 is moved along the longitudinal direction of the glass base material 40.

Figure 9A:
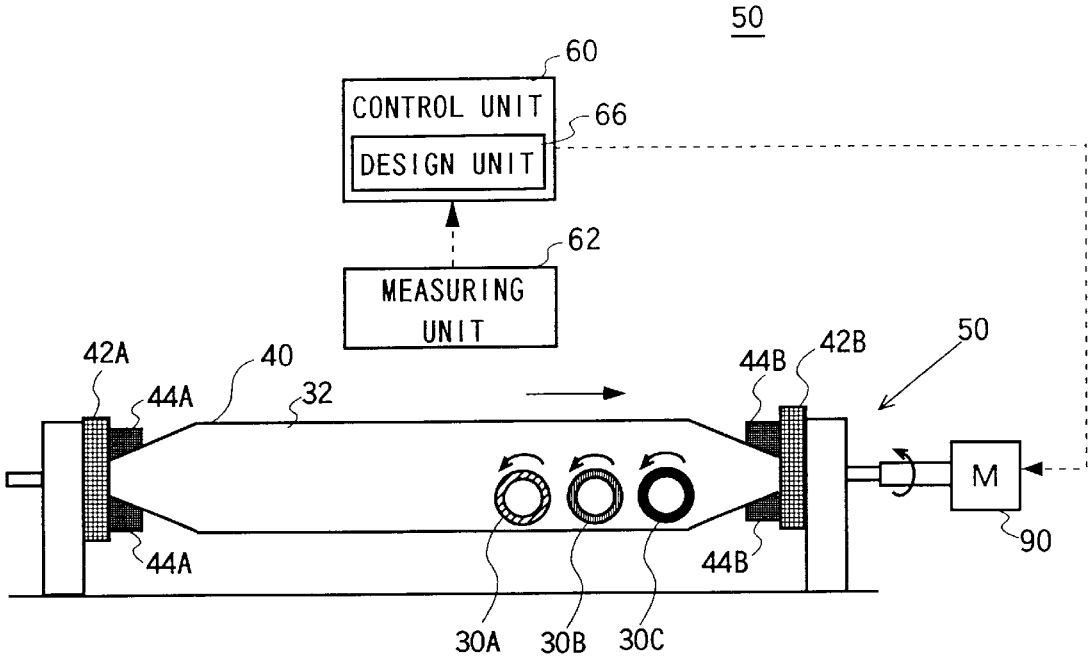
FIG. 9A and FIG. 9B show another embodiment of the configuration of the glass base material grinding apparatus 50.
Figure 9B:
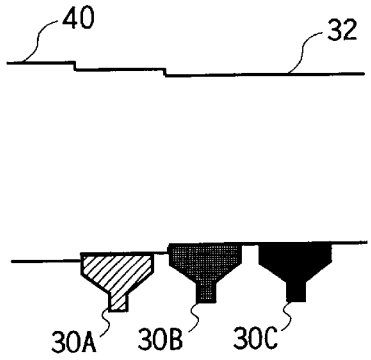

FIG. 9A and FIG. 9B show another embodiment of the configuration of the glass base material grinding apparatus 50. FIG. 9B shows a top view of the glass base material grinding apparatus shown in FIG. 9A. The glass base material grinding apparatus 50 has the same configuration as the configuration of the glass base material grinding apparatus 50 shown in FIG. 3 except the glass base material grinding apparatus 50 shown in FIG. 9 has a plurality of types of grinding wheels 30A, 30B, and 30C.

Each plurality of the grinding wheels 30A, 30B, and 30C has teeth, each of which has a different coarseness. By using a plurality of types of grinding wheels 30A, 30B, and 30C, the time taken for grinding the clad 32 can be greatly reduced. As shown in FIGS. 9A and 9B, the plurality of types of grinding wheels 30A, 30B, and 30C may be arranged along the longitudinal direction of the glass base material 40. Furthermore, the plurality of grinding wheels 30 may be arranged in parallel along the longitudinal direction of the glass base material 40 to increase the grinding speed.

The grinding wheels 30 may include a grinding wheel 30A having coarse teeth and a grinding wheel 30C having fine teeth. The grinding wheel 30B having coarseness between the grinding wheel 30A and 30C may be used. Moreover, the types of coarseness are not limited to the three types, but more than three types of the grinding wheels 30 may be used according to the contents of the grinding work.

A plurality of the grinding wheels 30A and a plurality of the grinding wheels 30C may be arranged in parallel along the longitudinal direction of the glass base material 40. As an example of the grinding wheel 30, a diamond wheel, which is a grinding wheel 30 using diamond, may be used. Also, a grinding wheel 30 using cubic boron nitride (CBN) may be used.

The control unit 60 of the glass base material grinding apparatus 50 shown in FIG. 9A controls the movement of each plurality of grinding wheels 30A, 30B, and 30C, respectively, based on the target diameter T calculated by the design unit 66. For example, the control unit 60 selects the type of grinding wheels 30A, 30B, and 30C for grinding the clad 32 according to the amount of eccentricity X between the position of the center $O_1$ of the core 36 and the position of the center $O_2$ of the glass base material 40.

The control unit 60 controls the movement of the grinding wheels 30A-30C such that the control unit 60 grinds the clad 32 using the grinding wheel 30A for coarse grinding and grinds the clad 32 using the grinding wheel 30B for fine grinding and further grinds the clad 32 using the grinding wheel 30C for the finest grinding.

First, the control unit 60 grinds the clad 32 deeply using the grinding wheel 30A having coarse teeth. Secondly, the control unit 60 changes the grinding wheels 30 from the grinding wheel 30A to the grinding wheel 30B, which has finer teeth than the grinding wheel 30A, and grinds the clad 32. Finally, the control unit 60 smoothes the surface of the clad 32 using the grinding wheel 30C having the finest teeth. Moreover, the control unit 60 may perform the coarse grinding and fine grinding at the same time by using the plurality of grinding wheels 30A, 30B, and 30C at the same time.

To obtain a glass base material having a further smooth surface and an accurate core/clad ratio, a finishing grinding may be performed on the glass base material. The finishing grinding does not have to be performed using the plurality of grinding wheels 30. A single grinding wheel 30 may be used to perform finishing grinding. Furthermore, the finishing grinding may be performed once or performed a plurality of times according to necessity.

The glass base material 40 grinded by the glass base material grinding apparatus 50 of the present embodiment is elongated to be a preform. Then, the preform is drawn to be an optical fiber.

The optical fiber obtained by drawing the glass base material, which is grinded by the glass base material grinding apparatus 50 of the present embodiment, has a good optical characteristic. In particular, a single-mode optical fiber obtained by drawing the glass base material, which is grinded by the glass base material grinding apparatus 50 of the present embodiment, has a good optical characteristic such as a good cutoff wavelength and a good dispersion characteristic.

The single-mode optical fiber obtained by drawing the glass base material, which is grinded by the glass base material grinding apparatus 50 of the present embodiment, also does not cause a connection loss when each end of two optical fibers are fused and connected to construct an optical fiber network.

EXAMPLE

A quarts glass for a single mode optical fiber having an outside diameter of 25 mmϕ and a length of 1200 mm was used as a core member 12. Both ends of the core member 12 were welded to the dummy rods 10. Then, the core member 12 was installed to the chucks 80 provided inside the reaction furnace 28 as shown in FIG. 1. Next, the core member 12 was rotated around the axis at the speed of 40 rpm by the motor 18.

Next, 75 L/min of oxygen gas, 150 L/min of hydrogen gas, 9 L/min of oxygen gas as a career gas, and 40 g/min of $SiCl_4$ as a raw material gas were supplied to the burner 20. A multiple-tube type oxyhydrogen flame burner was used for the burner 20.

Furthermore, the burner moving motor 24 moved the burner 20 back and forth at the speed of 150 mm/min in a range of 1600 mm along the burner guide structure 22. The raw material gas and the combustion gas ejected from the burner 20 were hydrolyzed with flame generated glass particles. The glass particles, which were generated by hydrolyzing $SiCl_4$ with flames, were accumulated on the core member 12. The exhaust gas inside the reaction furnace 28 was emitted from the exhaust hood 26.

The porous glass base material manufacturing apparatus increased the amount of raw material gas supplied to the burner 20 with the progress of the accumulation of the glass particles on the core member 12. Twenty four hours after the accumulation of the glass particles had started, the porous glass base material having an outside diameter of the 240 mmϕ was obtained. 180 L/min of oxygen gas, 360 L/min of hydrogen gas, 20 L/min of oxygen gas as a career gas, and 100 g/min of $SiCl_4$ as a raw material gas were supplied to the burner 20 just before the accumulation of the glass particles had ended. The average accumulation speed of the glass particles accumulated on the core member 12 was 31 g/min.

An uneven part existed helically around the surface of the obtained porous glass base material. By installing this porous glass base material in the furnace and dehydrating and sintering this porous glass base material, a transparent glass base material 40 having an outside diameter of 135 mmϕ was obtained. When observing the surface of the glass base material 40 with the naked eye, an uneven part remained helically on the surface of the glass base material 40. The maximum depth of the uneven part was 1.05 mm.

Next, the glass base material 40 was installed to the chucks 44A and 44B of the glass base material grinding apparatus 50 shown in FIG. 3. Then, the glass base material 40 was rotated around the axis by rotating the chucks 44A and 44B by the motor 90.

The measuring unit 62 measured the position of the center $O_1$ of the core 36 inside the glass base material 40 for each of the 50 places along the longitudinal direction of the glass base material 40 while the glass base material 40 was rotated. An optical measuring instrument using a polarizing glass was used as a measuring unit 62.

Next, the designunit 66 calculated the position of the center $O_1$ of the core 36 inside the glass base material 40 substantially continuous along the longitudinal direction of the glass base material 40. The design unit 66 calculated the position of the center $O_1$ of the core 36 for each place, which locates between the places where the position of the core 36 were measured, along the longitudinal direction of the glass base material 40 with estimation using the least-squares method. Therefore, the position of the center $O_1$ of the core 36 can be obtained substantially continuous along the longitudinal direction of the glass base material 40 by the measurement performed by the measuring unit 62 and the calculation performed by the design unit 66.

Next, the design unit 66 calculates the target diameter T, the position of the center $O_1$ of which is at the position of the center $O_1$ of the core 36, along the longitudinal direction of the glass base material 40 such that the estimated cutoff wavelength of the optical fiber, which is obtained by drawing the glass base material 40, becomes 1.27 $\mu$m.

The design unit 66 output the calculated results to the control unit 60. The control unit 60 grinded the clad 32 based on the position of the center $O_1$ of the core 36 measured by the measuring unit 62 and the target diameter T calculated by the design unit 66.

As a grinding wheel 30A for coarse grinding, a diamond wheel having a coarseness of JIS (Japanese Industrial Standards) #60 was used. The control unit 60 set the maximum grinding depth of the clad 32 by the grinding wheel 30A to be 0.75 mm. Furthermore, as a grinding wheel 30B, a diamond wheel having a coarseness of JIS (Japanese Industrial Standards) #140 was used. The control unit 60 set the maximum grinding depth of the clad 32 grinded by the grinding wheel 30B to be 0.3 mm deeper than the grinded face of the clad 32 grinded by the grinding wheel 30A.

Furthermore, as a grinding wheel 30C, a diamond wheel having a coarseness of JIS (Japanese Industrial Standards) #600 was used. The control unit 60 set the maximum grinding depth of the clad 32 grinded by the grinding wheel 30C to be 0.05 mm deeper than the grinded face of the clad 32 grinded by the grinding wheel 30B.

The glass base material grinding apparatus 50 grinded the glass base material 40 once by moving the glass base material 40 with the sending speed of 50 mm/min and moving the grinding wheels 30A-30C back and forth toward the center $O_2$ of the glass base material 40 based on the design of the design unit 66.

The glass base material grinding apparatus 50 cooled the grinded part of the glass base material 40 with water while the glass base material grinding apparatus 50 grinded the glass base material 40. In the above grinding process, the glass base material grinding apparatus 50 grinds the glass base material 40 such that the diameter of the glass base material 40 becomes the target diameter T, the position of the center of which is at the position of the center $O_1$ of the core 36, substantially continuous along the longitudinal direction of the glass base material 40.

The surface of the glass base material 40 became substantially smooth by this grinding process. The position of the center $O_1$ of the core 36 became substantially matched to the position of the center $O_2$ of the glass base material 40.

Next, similar to the above-mentioned grinding process, the design unit 66 determined the finishing size of the glass base material 40 along the longitudinal direction of the glass base material 40. The control unit 60 grinded the glass base material 40 based on the design of the design unit 66. At this time, the diamond wheel having a coarseness of JIS (Japanese Industrial Standards) #600 was used for the grinding wheel 30. The control unit 60 grinded the glass base material 40 once with the maximum grinding depth set to be 0.05 mm and the sending speed of the glass base material 40 to be 50 mm/min. The depth of the uneven part on the surface of the glass base material 40 obtained by this grinding was maximum 0.01 mm.

A preform was obtained by elongating the glass base material 40, which was obtained by the above-mentioned grinding process, with the electric furnace so that the diameter of the preform was to be 45 mmϕ. Furthermore, an optical fiber having an outside diameter of 125 μm was manufactured by drawing the preform.

A connection loss of this optical fiber, the eccentricity of the core 36, and the fluctuation range of the cutoff wavelength λc along the longitudinal direction of the optical fiber were measured. The connection loss of the optical fiber was measured using the optical time domain refractometery (OTDR) method. The eccentricity of the core 36 was measured using an optical fiber structure measuring apparatus of a MODEL 2400 manufactured by Photon Kinetics Inc. The fluctuation range of the cutoff wavelength λc was measured using a cutoff wavelength measuring apparatus. ITU-T G650 was applied for measuring the fluctuation range of the cutoff wavelength λc.

FIG. 10 shows a result of measuring the above-mentioned items. As shown in FIG. 10, the example of the present embodiment shows better results than the results obtained by the comparative example explained below.

COMPARATIVE EXAMPLE

First, the porous glass base material manufacturing process, and the dehydrating and sintering process, the same as described in the EXAMPLE, were applied to obtain a transparent glass base material 40 having an outside diameter of 135 mmϕ. The maximum depth of the uneven part on the surface of the glass base material was 1.03 mm.

Furthermore, the position of the center $O_1$ of the core 36 inside the glass base material 40 was measured for each 50 places along the longitudinal direction of the glass base material 40.

The position of the center $O_1$ of the core 36 inside the glass base material 40 was estimated along the longitudinal direction of the glass base material 40 from the average value of the measuring result. Also, the finishing size of the glass base material 40 was determined so that the cutoff wavelength of the optical fiber obtained from this glass base material became 1.27 μm.

Next, the glass base material was installed in the glass base material grinding apparatus. The glass base material grinding apparatus grinded the glass base material so that the position of the center $O_1$ matched the position of the center $O_2$ of the glass base material. However, contrary to the EMBODIMENT, each diamond wheel did not move back and forth toward the center $O_2$ of the glass base material 40 while the grinding wheel grinded the glass base material. Therefore, the grinding wheel kept a constant position against the glass base material during the grinding process.

Next, similar to the EMBODIMENT, the finishing size of the glass base material was determined for the glass base material obtained by the grinding process, and the glass base material was grinded based on the determined finishing size. The diamond wheel having a coarseness of JIS (Japanese Industrial Standards) #600 was used for grinding the glass base material. The grinding depth was set to 0.05 mm, and the sending speed of the glass base material was set to 50 mm/min. The glass base material was grinded once according to the setting. The depth of the uneven part on the surface of the glass base material obtained by this finishing grinding was maximum 0.01 mm.

A preform was obtained by elongating the glass base material, which was obtained by the above-mentioned grinding process, with the electric furnace so that the diameter of the preform was 45 mmϕ. Furthermore, an optical fiber having an outside diameter of 125 μm was manufactured by drawing this preform.

A connection loss of this optical fiber, the eccentricity of the core 36, and the fluctuation range of the cutoff wavelength λc along the longitudinal direction of the optical fiber were measured as being similar to the EMBODIMENT. As shown in FIG. 10, the connection loss, the eccentricity of the core 36, and the fluctuation range of the cutoff wavelength λc of the COMPARATIVE EXAMPLE became larger than those of the EXAMPLE.

As apparent from the above explanation, a glass base material having a smooth surface and an excellent core eccentricity can be manufactured in a short time according to the present invention. Therefore, the optical fiber obtained by drawing the manufactured glass base material has good optical characteristics. In particular, the single mode optical fiber obtained by drawing the glass base material manufactured by the present embodiment has a low connection loss, low core eccentricity, and good uniformity of the cutoff wavelength.

Although the present invention has been described by way of exemplary embodiments, it should be understood that those skilled in the art might make many changes and substitutions without departing from the spirit and the scope of the present invention which is defined only by the appended claims.

What is claimed is:

1. An apparatus for grinding a glass base material having a core and a clad comprising:

a grinding wheel for grinding said clad;

a measuring unit for measuring an eccentricity between a center position of said glass base material and a center position of said core in a direction perpendicular to a longitudinal direction of said glass base material at a plurality of positions along a longitudinal direction of said glass base material;

a design unit for calculating target diameters of said glass base material substantially continuous throughout the longitudinal direction of said glass base material by calculating said target diameters, a center position of said target diameter is the same as the center position of said core for each of said plurality of positions along a longitudinal direction of said glass base material, so that said eccentricity becomes substantially zero for each of said plurality of positions where said eccentricity is measured by said measuring unit; and a control unit for controlling said grinding wheel to grind said clad so that a diameter of said glass base material to be said target diameter, center position of which is at said center position of said core, substantially continuous throughout the longitudinal direction of said glass base material based on said target diameters calculated by said design unit.

2. An apparatus as claimed in claim 1, wherein said design unit calculates said target diameter substantially continuous throughout the longitudinal direction of said glass base material by calculating said target diameter at a position between said plurality of positions where said eccentricity is measured by said measuring unit based on said eccentricity measured at said plurality of positions by said measuring unit.

3. An apparatus as claimed in claim 2, wherein said design unit calculates said target diameter at a position between said plurality of positions using the least-squares method.

4. An apparatus as claimed in claim 1, wherein said control unit grinds said clad by moving said grinding wheel back and forth in the direction toward said center of said glass base material.

5. An apparatus as claimed in claim 4, wherein said control unit rotates said glass base material around the axis of said glass base material and moves said grinding wheel back and forth toward said center of said glass base material so that movement of said grinding wheel against said glass base material forms a sine curve with an increase of an amount of rotation of said glass base material.

6. An apparatus as claimed in claim 1, wherein a number of said plurality of positions for measuring said eccentricity along a longitudinal direction of said glass base material is substantially more than twenty.

7. An apparatus as claimed in claim 2, wherein said design unit calculates said target diameters at each of said plurality of positions and said positions between said plurality of positions so that a ratio between a diameter of said core and a diameter of said glass base material becomes substantially constant throughout a longitudinal direction of said glass base material.

8. An apparatus as claimed in claim 1, wherein said grinding wheel includes:

a coarse grinding wheel having a coarse surface;

a fine grinding wheel having a fine surface; and said control unit grinds said clad by said fine grinding wheel after grinding said clad by said coarse grinding wheel.

9. An apparatus as claimed in claim 1, further comprising a plurality of said grinding wheels, wherein said grinding wheels are arranged parallel along a longitudinal direction of said glass base material.

10. A method for manufacturing a glass base material having a core and a clad comprising:

accumulating glass particles around a core member, which becomes said core, to form a porous glass base material;

dehydrating and sintering said porous glass base material to form glass base material;

measuring an eccentricity between a center position of said glass base material and a center position of said core in a direction perpendicular to a longitudinal direction of said glass base material at a plurality of positions along a longitudinal direction of said glass base material;

calculating target diameters of said glass base material substantially continuous throughout the longitudinal direction of said glass base material by calculating said target diameters, a center position of said target diameter is the same as the center position of the core for each of said plurality of positions along a longitudinal direction of the glass base material, so that said eccentricity becomes substantially zero for each of said plurality of positions where said eccentricity is measured by said measuring; and grinding said clad with a grinding wheel so that a diameter of said glass base material to be said target diameter, said center position of which is at said center position of said core, substantially continuous throughout the longitudinal direction of said glass base material based on said target diameters calculated substantially continuous throughout the longitudinal direction of said glass base material.

11. A method as claimed in claim 10, wherein said calculating calculates said target diameter substantially continuous throughout the longitudinal direction of said glass base material by calculating said target diameter at positions between said plurality of positions where said eccentricity is measured by said measuring based on said eccentricity measured at said plurality of positions by said measuring.

12. A method as claimed in claim 11, wherein said calculating calculates said target diameter at positions between said plurality of positions using the least-squares method.

13. A method as claimed in claim 10, wherein said grinding grinds said clad by moving said grinding wheel back and forth in the direction toward said center of said glass base material.

14. A method as claimed in claim 13, wherein said grinding rotates said glass base material around the axis of said glass base material and moves said grinding wheel back and forth toward said center of said glass base material so that movement of said grinding wheel against said glass base material forms a sine curve with an increase of an amount of rotation of said glass base material.

15. A method as claimed in claim 10, wherein said measuring measures said eccentricity along a longitudinal direction of said glass base material for more than twenty places along a longitudinal direction of said glass base material.

16. A method as claimed in claim 10, wherein said calculating calculates said target diameters at each of said plurality of positions and said positions between said plurality of positions so that a ratio between a diameter of said core and a diameter of said glass base material becomes substantially constant throughout a longitudinal direction of said glass base material.

17. A method as claimed in claim 13, wherein said grinding grinds said clad by a fine grinding wheel, which has a fine surface, after grinding said clad by a coarse grinding wheel, which has a coarse surface.

18. A method as claimed in claim 13, wherein said grinding grinds said clad using a plurality of said grinding wheels arranged parallel along a longitudinal direction of said glass base material.

* * * * *